United States Patent [19]

Hunt

[11] Patent Number: 4,867,891

[45] Date of Patent: Sep. 19, 1989

[54] OVERBASED ALKALI METAL SULFONATES

[75] Inventor: Mack W. Hunt, Naperville, Ill.

[73] Assignee: Amoco Corporation, Chicago, Ill.

[21] Appl. No.: 237,150

[22] Filed: Aug. 26, 1988

[51] Int. Cl.[4] ..... C10M 135/10

[52] U.S. Cl. ..... 252/33; 252/25; 252/33.4

[58] Field of Search ..... 252/25, 18, 33, 33.4

[56] References Cited

U.S. PATENT DOCUMENTS

| | | | |
|---|---|---|---|
| 3,372,115 | 3/1968 | McMillen | 252/33 |
| 3,436,347 | 4/1969 | Otto et al. | 252/33 |
| 4,164,474 | 8/1979 | Gallacher et al. | 252/33 |
| 4,387,033 | 6/1983 | Lenack et al. | 252/25 |

*Primary Examiner*—Jacqueline V. Howard

*Attorney, Agent, or Firm*—Matthew R. Hooper; William H. Magidson; Ralph C. Medhurst

[57] ABSTRACT

A method of preparing a carbonate overbased alkali metal sulfonate, which method comprises: (1) forming a reaction mixture of an alkali metal compound, a lower molecular weight akanol having from 1 to 4 carbon atoms, a diluent, a solvent, and a sulfonate compound; (2) heating said reaction mixture to a temperature of a least 140° C. (220° F.) for a period of time that is sufficient to remove essentially all of said alakanol as overhead and to obtain a heated mixture and replacing the solvent that is removed along with said alkanol; (3) carbonating said heated mixture at a temperature of at least 140° C. (220° F.) to form a carbonated product comprising said overbased alkali metal sulfonate while removing water of reaction as overhead as it is formed; (4) after carbonation, heating said carbonated product to a temperature that is within the range of about 116°0 C. (240° F.) to about 117° C. (350° F.) to remove any residula water of reaction therefrom; and (5) subsequently treating said carbonated product to remove solids and residual solvent therefrom.

21 Claims, No Drawings

OVERBASED ALKALI METAL SULFONATES

BACKGROUND OF THE INVENTION

1. Field of the Invention

This invention relates to overbased alkali metal sulfonates and lubricating oil compositions containing said sulfonates. More particularly, it relates to carbonate overbased alkali metal sulfonates that are prepared in a unique manner which minimizes formation of a hazy product.

2. Description of the Prior Art

The use of the normal salts of petroleum sulfonic acids as additives for lubricating oil compositions is well known. During World War II, normal metal sulfonates that were derived from mahogany or petroleum sulfonic acids were employed as detergent additives in internal combustion engine crankcase oils. Calcium or barium was employed as the metal in such sulfonates. Subsequently, sulfonate products which contained as much as twice as much metal as the corresponding normal or neutral metal sulfonate were found to have improved detergent power and ability to neutralize acidic contaminants and, hence, were used in the place of the normal sulfonates. More recently, fully oil-soluble sulfonates containing from 3 up to 20 or more times as much metal as a corresponding normal metal sulfonate have been developed. These highly basic sulfonates have been identified as "overbased," "superbased," and "hyperbased."

Over the years, numerous methods for preparing overbased sulfonates have been disclosed. In general, such overbased sulfonates have been prepared by mixing a promoter and a solvent with a normal sulfonate and an excessive amount of a metallic base of either an alkali metal or an alkaline earth metal, heating the resulting mixture, carbonating the resulting reaction mass with sufficient carbon dioxide to increase the amount of metal base colloidally dispersed as metal carbonate in the resulting product, and then filtering the resulting material.

In U.S. Pat. No. 3,488,284, LeSuer, et al. disclosed the preparation of basic metal complexes wherein a mixture of an oil-soluble organic acid compound, such as a sulfonic acid, a basically reacting metal compound, such as sodium hydroxide, and an alcoholic promoter having from one to four hydroxyl groups, such as methanol, are treated with an inorganic acidic material, such as carbon dioxide, to form the desired basic metal complex and subsequently the volatile materials, primarily the alcoholic promoter, are stripped from the product mass. They disclosed further that, during the step that the mixture is treated with the inorganic acidic material, the mixture must contain substantially no free water and, if water is liberated during this step, such as the water of hydration in the basically reacting metal compound, reaction conditions should be such that substantially all of such liberated water is driven off as it is formed.

In West German Patent No. 1,122,526, Groot disclosed a method for the preparation of an alkali metal salt of an organic carboxylic acid or an organic sulfonic acid having a high degree of basicity. According to this patent, the oil-soluble basic alkali metal salt of organic sulfonic acids or carboxylic acids is prepared by the method which comprises reacting the alkali salt of the organic acid dissolved in hydrocarbon oil, in the presence of water, and/or of an oxygen-containing organic solvent which is miscible with water, with the carbonate of an alkali metal, which is formed conveniently in the reaction mixture itself. The organic solvent can be selected from aliphatic alcohols, such as methanol, ethanol, propanol, isopropanol, normal-butanol, and isobutanol. The carbonate of a particular alkali metal can be formed in situ by the addition of the hydroxide of the alkali metal to the reaction mixture and the subsequent passage of carbon dioxide through the reaction mixture. While this West German patent disclosed that temperatures between 20° C. (68° F.) and 150° C. (302° F.), especially between 40° C. (104° F.) and 120° C. (248° F.), are suitable, the patent disclosed that the process should be carried out at a temperature that preferably does not exceed the boiling point of the lowest boiling reactant in the reaction mixture. It then disclosed that the reaction mixture can be dried by heating to temperatures of 135° C. (275° F.) to 160° C. (320° F.). In each of the examples, the temperature during the addition of the carbon dioxide to the reaction mixture was kept well below 100° C. (212° F.).

In United Kingdom Patent Specification No. 1,481,553, King disclosed a process for the preparation of a stable oil-soluble dispersion of a basic alkali metal sulfonate having a metal ratio of at least 4, wherein an acidic gaseous material selected from carbon dioxide, hydrogen sulfide, sulfur dioxide, and mixtures thereof was contacted with a reaction mixture comprising one or more oil-soluble sulfonic acids or derivatives thereof, one or more alkali metals, alkali metal hydrides, or basically reacting alkali metal compounds, one or more lower aliphatic alcohols, and one or more oil-soluble carboxylic acids or derivatives thereof for a period of time that was sufficient for the acidic gaseous material and the components of the reaction mixture to form a dispersion of basic alkali sulfonate having the desired metal ratio. The reaction was carried out at a temperature within the range of 25° C. (77° F.) to 200° C. (392° F.).

In U.S. Pat. No. 4,326,972, Chamberlin disclosed the preparation and use of an oil-dispersible basic alkali metal sulfonate. In the preparation, a reaction mixture comprising at least one oil-soluble sulfonic acid or derivative thereof, at least one alkali metal or basic alkali metal compound, at least one lower aliphatic alcohol, and at least one oil-soluble carboxylic acid or functional derivative thereof is reacted with at least one acidic gaseous material selected from the group consisting of carbon dioxide, hydrogen sulfide, sulfur dioxide, and mixtures thereof. Chamberlin disclosed that the reaction temperature was not critical and that it would be between the solidification temperature of the reaction mixture and its decomposition temperature, i.e., the lowest decomposition temperature of any component of the mixture. He indicated that usually the temperature would be from about 25° C. (77° F.) to about 200° C. (392° F.), preferably from about 50° C. (122° F.) to about 150° C. (302° F.). In an example, carbon dioxide flow was utilized while the temperature was less than 100° C. (212° F.).

There has now been found a method for preparing a superior carbonate overbased alkali metal sulfonate. This overbased sulfonate is an extremely clear product. It has a very high base number, is oil soluble, and is low in viscosity.

SUMMARY OF THE INVENTION

According to the present invention, there is provided a method for preparing a carbonate overbased alkali metal sulfonate, wherein a mixture of an alkali metal compound, a lower molecular weight alkanol having from 1 to 4 carbon atoms, a diluent, a solvent, and a sulfonate compound are mixed to form a mixture, the mixture is heated to a temperature of at least 104° C. (220° F.) for a period of time that is sufficient to remove substantially all of the alkanol as overhead and to obtain a heated mixture, while solvent that is removed is replaced, the heated mixture is contacted with carbon dioxide at a temperature of at least 104° C. (220° F.) to form a carbonated product, the carbonated product is heated after carbonation to a temperature within the range of about 116° C. (240° F.) to about 177° C. (350° F.) to remove any residual water of reaction therefrom and any remaining alcohol, and the resultant carbonated product is treated for removal of solids and any residual solvent therefrom. A preferred alkali metal compound is sodium hydroxide. A preferred alkanol is methanol. Solvents such as xylene, toluene, and isooctane are suitable. A suitable diluent is a low-viscosity lubricating oil.

The reaction product, an alkali metal carbonate overbased alkali metal sulfonate, can be used suitably as a lubricating oil additive. Accordingly, there is also provided a lubricating oil composition, which composition comprises an oil of lubricating viscosity and a minor amount of the aforementioned carbonate overbased alkali metal sulfonate.

DESCRIPTION AND PREFERRED EMBODIMENTS

Detergents are important components of a lubricating oil composition. An example of such detergent is an overbased alkali metal sulfonate, which is employed not only for its detergent properties, but also for its ability to neutralize acidic contaminants in a lubricating oil composition.

According to the present invention, there is provided a method for preparing an alkali metal carbonate overbased alkali metal sulfonate, which method comprises: (1) forming a mixture of an alkali metal compound, a lower molecular weight alkanol having from 1 to 4 carbon atoms, a diluent, a solvent, and a sulfonate compound; (2) heating said mixture to a temperature of at least 104° C. (220° F.) for a period of time that is sufficient to remove essentially all of said alkanol as overhead and to obtain a heated mixture and replacing the solvent that is removed along with said alkanol; (3) carbonating said heated mixture at a temperature of at least 104° C. (220° F.) to form a carbonated product comprising said overbased alkali metal sulfonate while removing water of reaction as overhead as it is formed; (4) after carbonation, heating said carbonated product to a temperature that is within the range of about 116° C. (240° F.) to about 177° C. (350° F.) to remove any residual water of reaction therefrom; and (5) subsequently treating said carbonated product to remove solids and residual solvent therefrom.

This method can be distinguished from the method disclosed by LeSuer, et al. in U.S. Pat. No. 3,488,284, since the LeSuer, et al. method strips the volatile materials, including the alcoholic promoter, from the product mass after carbonation and does not require a solvent. In addition, the LeSuer, et al. method does not require a temperature during carbonation of at least 104° C. (220° F.).

According to one embodiment of the method of the present invention, there is provided a method for preparing an alkali metal carbonate overbased alkali metal sulfonate, which method comprises: (1) mixing an alkyl-substituted sulfonate compound, a diluent, and a solvent to form a sulfonate-containing mixture; (2) preparing a solution of an alkali metal compound dissolved in a lower molecular weight alkanol having from 1 to 4 carbon atoms; (3) adding said solution to said sulfonate-containing mixture to obtain a reaction mixture; (4) heating said reaction mixture to a temperature of at least 104° C. (220° F.) for a period of time that is sufficient to remove essentially all of said alkanol as overhead and obtain a heated mixture and replacing the solvent that is removed along with said alkanol; (5) passing carbon dioxide through said reaction mixture at a temperature of at least 104° C. (220° F.) to form a carbonated product comprising said alkali metal carbonate overbased alkali metal sulfonate while removing water of reaction as overhead as it is formed; (6) when carbonation has been completed, stopping the flow of carbon dioxide and heating the carbonated product to a temperature within the range of about 116° C. (240° F.) to about 177° C. (350° F.) to remove any remaining alcohol or residual water of reaction; and (7) treating said carbonated product to remove solids and solvent therefrom.

The resulting product of the above-described method of preparation is a carbonate overbased alkali metal sulfonate. The term "overbased" can be used synonymously with such names as "basic" and "superbased." As used herein and in the appended claims, the term "overbased alkali metal sulfonates" refers to those sulfonates which are characterized by having a stoichiometric excess of the alkali metal component, in relation to the sulfonic acid component. Accordingly, a normal alkali metal sulfonate would have a ratio of equivalents of alkali metal to equivalents of sulfonate of 1:1, while an overbased sulfonate would have a ratio of equivalents of alkali metal to equivalents of sulfonate that is greater than 1:1.

The basicity of an overbased sulfonate can be expressed conveniently as a total base number (TBN), which is determined by ASTM Test No. D-2896 and is defined as the number of milligrams of potassium hydroxide which are equivalent to the amount of acid required to neutralize the alkaline material present in one gram of the composition being tested.

One of the components of the mixture is a sulfonate compound. A suitable sulfonate compound is an ammonium salt or a metal salt of a sulfonic acid, such as sodium sulfonate, or a sulfonic acid. Examples of sulfonic acids are mahogany or petroleum sulfonic acids, petrolatum sulfonic acids, mono- and polywax-substituted naphthalene sulfonic acids, paraffin wax sulfonic acids, unsaturated paraffin wax sulfonic acids, hydroxy-substituted paraffin wax sulfonic acids, and petroleum naphthalene sulfonic acids. Metal salts and ammonium salts of sulfonic acids are quite susceptible to overbasing. Sulfonic acids are prepared by treating petroleum products with sulfuric acid or $SO_3$. The compounds in the petroleum product which become sulfonated contain an oil solubilizing group, such as hydrocarbyl groups, which are organic radicals composed of carbon and hydrogen except for minor amounts of other elements, such as oxygen, chlorine, and the like. The hydrocarbyl group can be an aliphatic or an aromatic radical, or a radical which is a combination of an aliphatic and an aromatic radical, i.e., an alkaryl radical. It is preferred that the hydrocarbyl group be aliphatic and relatively free of aliphatic unsaturation. The hydrocarbyl substituents should contain at least 18 carbon atoms and typically will contain from 30 carbon atoms up to 200 carbon atoms, and higher. As used herein, the equivalent weight of a sulfonic acid or its derivative is its molecular weight divided by the number of sulfonic acid groups or sulfonic acid derivative groups present therein.

The alkali metal compound that is employed in the method of the present invention can be selected suitably from the group consisting of lithium, sodium, and potassium hydroxides, alkoxides, hydrides, and amides. Suitable and useful basic alkali metal compounds include sodium hydroxide, potassium hydroxide, lithium hydroxide, sodium propoxide, lithium methoxide, potassium ethoxide, sodium butoxide, lithium hydride, sodium hydride, potassium hydride, lithium amide, sodium amide, and potassium amide. Preferred alkali metal compounds are sodium hydroxide and sodium alkoxides, i.e., those containing up to 4 atoms. Since the alkali metals are monovalent, the equivalent weight of the alkali metal compound is equivalent to the molecular weight of the particular compound.

The lower molecular weight alkanol is employed as a promoter and is selected conveniently from those alkanols having from 1 to 4 carbon atoms, such as methanol, ethanol, 1-propanol, isopropanol, and isobutanol. Preferably, methanol is employed as the alkanol.

In the method of the present invention, essentially all of the alkanol is removed prior to the carbonation treatment. The term "essentially all" in this instance refers to an amount of at least about 80 percent of the alkanol and preferably to at least about 90 percent of the alkanol.

The solvent that is employed in the method of the present invention is selected from aliphatic and aromatic organic liquids having boiling points that are greater than 93° C. (200° F.). Typically, such solvents will have boiling points that fall within the range of about 93° C. (200° F.) to about 204° C. (400° F.). Suitable liquids are n-heptane, xylene, and toluene. Other solvents are the halogenated derivatives of such liquid media. A preferred solvent is xylene.

Diluents that are suitable for use in the method of the present invention include any inert diluent. Preferably, any natural or synthetic oil of lubricating viscosity comprises a suitable diluent. While any oil of lubricating viscosity can be used as a diluent, oils which typically have viscosities within the range of about 35 Saybolt Universal Seconds (SUS) at 37.8° C. (100° F.) to about 500 SUS at 37.8° C. (100° F.) are preferred.

The various components that are employed in the reaction mixture for the preparation of the alkali metal carbonate overbased alkali metal sulfonates of the present invention are present in the reaction mixture in the amounts enumerated hereinbelow in Table I.

TABLE I

| COMPOSITION OF INITIAL REACTION MIXTURE | | |
|---|---|---|
| | Amount, wt. % (1) | |
| Component | Typical | Preferred |
| Diluent | 6–20 | 9–12 |
| Solvent | 30–60 | 35–45 |
| Sulfonate Compound | 4–8 | 5–6 |
| Alkanol Sol'n of | 20–45 | 40–45 |

TABLE I-continued

| COMPOSITION OF INITIAL REACTION MIXTURE | | |
|---|---|---|
| | Amount, wt. % (1) | |
| Component | Typical | Preferred |
| Alkali Metal (2) | | |

(1) based upon weight of reaction mixture.
(2) contains about 5 wt % to about 20 wt % alkali metal compound, preferably about 15 wt % to about 20 wt % alkali metal compound, based upon the weight of the alkanol solution.

The sulfonates that are prepared by the method of the present invention are alkali metal carbonate overbased alkali metal sulfonates wherein the hydrocarbyl substituents can be an alkyl radical or an alkaryl radical. If it is an alkyl radical, it will contain from about 18 to about 200 carbon atoms, preferably from about 30 to about 100 carbon atoms, and more preferably from about 30 to about 50 carbon atoms. If it is an alkaryl radical, such as alkyl benzene radical, it will contain from about 14 to about 70 carbon atoms, preferably from about 18 to about 30 carbon atoms. The alkyl chain should be substantially saturated to provide stability. The term "substantially saturated" means that at least about 90 percent, and preferably about 95 percent, of the carbon-to-carbon covalent linkages are saturated. If the molecule contains too many sites of unsaturation, the molecule can be more easily polymerized, oxidized, and/or degraded. Too much oxidation and polymerization will make the product unsuitable for use in hydrocarbon oils. The substantially saturated alkyl substituents can be derived principally from substantially saturated olefin polymers, particularly polymers of monoolefins having from about 2 to about 5 carbon atoms. Polymers of 1-monoolefins, such as ethylene, propene, 1-butene, and isobutene are particularly useful.

The carbonate overbased alkali metal sulfonate that is prepared by the method of the present invention can be used suitably as a detergent in a lubricating oil composition. Suitable lubricating oils that are contemplated for use in such lubricating oil composition are oils of lubricating viscosity derived from either petroleum sources or synthetic sources. The oils can be paraffinic, naphthenic, halo-substituted hydrocarbons, synthetic esters, or combinations thereof. Such oils are those that are conventionally used in the manufacture of lubricants. Suitable lubricating oils include those having a viscosity within the range of about 35 SUS to about 1,000 SUS at 37.8° C. (100° F.), preferably within the range of about 35 SUS to about 500 SUS at 37.8° C. (100° F.), and more preferably within the range of about 50 SUS to about 350 SUS at 37.8° C. (100° F.). The oils can be refined or otherwise processed to produce an oil having the quality desired. Of course, combinations of two or more different oils in a single lubricating composition are contemplated. For lubricating oil compositions of the present invention, it is desired that such compositions comprise a major proportion of the oil of lubricating viscosity, i.e., about 70 wt % of the oil having lubricating viscosity, preferably at least about 90 wt % of the oil having lubricating viscosity, based upon the total weight of the composition. The lubricating oil compositions of the present invention will contain from about 10 wt % to about 45 wt % of the desired alkali metal carbonate overbased alkali metal sulfonate, preferably from about 15 wt % to about 40 wt % alkali metal carbonate overbased alkali metal sulfonate, based upon the weight of the lubricating oil composition.

According to the present invention, there is also provided the alkali metal carbonate overbased alkali metal sulfonate that is produced by the method of the present invention and the lubricating oil composition that employs the aforesaid overbased alkali metal sulfonate.

Accordingly, the lubricating oil composition of the present invention comprises a major proportion of an oil having lubricating viscosity and a minor proportion of the alkali metal carbonate overbased alkali metal sulfonate prepared by the method of the present invention. Furthermore, such lubricating oil composition can contain other additives which are used conventionally in lubricating oil compositions. Such other additives can be used in combination with the alkali metal carbonate overbased alkali metal sulfonate of the present invention. Such other additives include, but are not limited to, oxidation inhibitors, viscosity index improvers, dispersants, antifoam agents, pour point depressants, and similar additives.

The lubricating oil compositions that are prepared according to the present invention are useful for lubricating internal combustion engines. Such lubricating oil compositions not only lubricate the internal combustion engine in which they are being used, but also support cleanliness in the various lubricated parts of the engine. The alkali metal carbonate overbased alkali metal sulfonates of the present invention are particularly useful as additives for fuel economy oils and railway diesel oils.

The following examples are presented for the purpose of illustration only and are not intended to limit the scope of the present invention.

Example 1

This example demonstrates an embodiment of the method of the present invention, i.e., a method for preparing a carbonate overbased alkali metal sulfonate.

For this test, Test No. 1, 81.3 g of typical commercial grade ammonium sulfonate obtained from Amoco Petroleum Products Company, 200 ml of technical grade xylene obtained from Baker Chemical Company, and 25.9 g of a 5W oil obtained from Amoco Oil Company were charged to a 1-liter flask that was equipped with a mechanical mixer, condenser, and gas sparger. The flask then contained 44.5 percent sulfonate, 35 percent oil, and 20.5 percent xylene. Mixing of the contents of the flask was initiated. A 250 g portion of a previously prepared solution of 20 percent sodium hydroxide dissolved in methanol was added to the contents of the flask. The sodium hydroxide and the methanol were C.P. grade materials and were obtained from the Baker Chemical Company. The mixture was then heated to a temperature of about 116° C. (240° F.). During the heating, about 385 ml of methanol/xylene were removed from the flask and 350 ml of fresh xylene were added to prevent any appreciable increase in the viscosity of the mixture. The distillate and addition sequences of the preparation are presented hereinbelow in Table II.

TABLE II

DISTILLATION AND XYLENE ADDITION DATA FROM TEST NO. 1

| Temperature °C. | Temperature °F. | Total Overhead ml | Xylene Added ml |
|---|---|---|---|
| 76 | 169 | — | 50 |
| 79 | 174 | — | 25 |
| 83 | 181 | 45 | 75 |
| 84 | 183 | 65 | — |
| 87 | 189 | 110 | 75 |

TABLE II-continued

DISTILLATION AND XYLENE ADDITION DATA FROM TEST NO. 1

| Temperature °C. | Temperature °F. | Total Overhead ml | Xylene Added ml |
|---|---|---|---|
| 90 | 193 | 135 | 25 |
| 90 | 194 | 180 | — |
| 91 | 196 | 230 | — |
| 94 | 201 | 270 | — |
| 100 | 211 | 290 | 100 |
| 103 | 218 | 300 | — |
| 111 | 232 | 320 | — |
| 115 | 238 | 370 | — |
| 115 | 239 | 385 | — |
| 117 | 241 | 390 | — |
| TOTAL | | 390 | 350 |

At this point, the mixture was fluid and had two phases. The hydroxide phase was partially gelatinous.

Carbon dioxide was then added to the mixture at a rate of 0.25 g per minute. A total of 25.5 g of carbon dioxide was added at a temperature of about 116° C. (240° F.). Water was formed during the carbonation and this was removed as overhead material and was condensed. A carbonation profile and the resulting overheads are presented hereinbelow in Table III.

TABLE III

CARBONATION PROFILE AND OVERHEAD PRODUCED IN TEST NO. 1

| $CO_2$ Added g | Total Overhead, ml |
|---|---|
| Start | — |
| 5.5 | 6 |
| 7.5 | 9 |
| 9.5 | 11.5 |
| 13.2 | 16.5 |
| 15.5 | 18.5 |
| 24.7 | 39.5 |
| 25.5 | 42.5 |

When approximately 7.5 g of carbon dioxide had been used, the gelatinous appearance of the hydroxide phase disappeared. After the carbonation had been completed, the heating was continued to a temperature of 127° C. (260° F.) to remove any residual water of reaction. The product was isolated by centrifuging the solids and removing the xylene by means of distillation. The resultant product, identified hereinafter as Product A, was an extremely clear product and had a TBN of 366. It was oil soluble and was found to be low in viscosity. The viscosity was 71 cs at 210° F.

It was found that the method of preparation of the present invention produces a superior carbonate overbased alkali metal sulfonate when compared to conventional sulfonates. Water is present and also formed during the carbonation step. Water causes instability. By removing most of the methanol in the early part of the preparation, some of the water is also removed at that time. This increases the stability. Furthermore, note that the carbonation was done at a very high temperature and that the water that was formed during the carbonation was removed as overhead material. The removal of the water as it was formed provided a very clear product. If this were not done, the product would have been hazy and, of course, unacceptable for use in a motor oil.

It is important to carbonate at high temperatures. The temperature for carbonation should be at least at a temperature of 104° C. (220° F.). It is contemplated that suitable temperatures for carbonation should fall within the range of about 104° C. (220° F.) to about 127° C. (260° F.). Preferably, carbonation should be conducted at a temperature within the range of about 113° C. (235° F.) to about 119° C. (245° F.).

Carbon dioxide is used at a rate within the range of about 1.8 g per minute to about 0.08 g per minute and for a time within the range of about 15 minutes to about 5 hours, or longer.

Subsequent to carbonation the product is heated to a temperature within the range of about 116° C. (240° F.) to about 177° C. (350° F.), preferably within the range of about 116° C. (240° F.) to about 132° C. (270° F.) to remove residual water of reaction.

Example 2

A second test, identified hereinafter as Test No. 2, was conducted. In this test, an embodiment of the method of the present invention provided a sodium carbonate overbased sodium sulfonate, hereinafter identified as Product B.

To a suitable vessel equipped with a mechanical stirrer, condenser, and gas sparger, were added 406.5 g of a commercially-produced ammonium sulfonate composition obtained from the Amoco Petroleum Products Company, 129.5 g of a 5W oil obtained from Amoco Oil Company, and 1,000 ml of technical grade xylene obtained from Baker Chemical Company. The ammonium sulfonate composition contained 46.2 percent sulfonate having an equivalent weight of 680, 51.8 percent oil, and 2 percent solvent. The contents of the vessel were mixed thoroughly. To the resulting mixture were added 1,300 g of a previously prepared solution of 20 percent sodium hydroxide in methanol.

The mixture was then heated to a temperature of about 107° C. (225° F.). During this heating, some of the xylene and most of the methanol was removed from the mixture. In order that a satisfactory viscosity be maintained, xylene was added as shown hereinbelow in Table IV.

TABLE IV

DISTILLATION AND XYLENE ADDITION DATA FROM TEST NO. 2

| Time, min. | Temperature, °C. | °F. | Total Overhead, ml | Xylene Added, ml |
|---|---|---|---|---|
| 0 | | 80 | — | — |
| 14 | | 172 | 1 | — |
| 19 | | 176 | 110 | — |
| 25 | | 181 | 330 | 250 |
| 29 | | 183 | 400 | 250 |
| 33 | | 186 | 500 | 250 |
| 34 | | 187 | 550 | 500 |
| 37 | | 189 | 630 | 500 |
| 40 | | 191 | 700 | 500 |
| 45 | | 194 | 880 | 500 |
| 47 | | 194 | 1,010 | 750 |
| 54 | | 194 | 1,230 | 1,000 |
| 57 | | 194 | 1,320 | 1,250 |
| 62 | | 204 | 1,550 | 1,250 |
| 65 | | 212 | 1,580 | 1,250 |
| 69 | | 216 | 1,670 | 1,250 |
| 76 | | 224 | 1,730 | 1,250 |
| 78 | | 225 | 1,760 | 1,250 |

As shown in Table IV, a total of 1,760 ml of xylenemethanol overhead was removed from the mixture. However, a total of 1,250 ml of fresh xylene was added to the contents in the reaction vessel. The final reaction mass was slightly gelatinous, had a pearlescence, and appeared to comprise two phases.

In the absence of cooling, carbonation was initiated at a temperature of 107° C. (225° F.) by passing carbon dioxide through the mass at a rate of about 1.3 g per minute. Water was formed during carbonation and was removed, along with some methanol, as overhead. The temperature and overhead production during this carbonation are provided hereinbelow in Table V.

TABLE V

CARBONATION PROFILE AND OVERHEAD IN TEST NO. 2

| Time, min. | Temperature, °C. | °F. | Total Overhead, ml |
|---|---|---|---|
| 0 | 107 | 225 | — |
| 6 | 107 | 225 | 29 |
| 8 | 107 | 225 | 40 |
| 12 | 106 | 224 | 60 |
| 38 | 106 | 223 | 240 |
| 64 | 107 | 225 | 405 |
| 100 | 107 | 225 | 605 |
| 106 | 107 | 225 | 615 |

After carbonation, the flow of carbon dioxide was stopped and the mixture was then heated to a temperature of about 127° C. (260° F.) in order to remove any residual water of reaction. The resulting product was clarified by diluting it to about 70 percent xylene and allowing the diluted material to stand overnight. Then the material was decanted and filtered. Removal of the solvent was accomplished by means of conventional distillation to a temperature of about 182° C. (360° F.) with nitrogen stripping.

The finished product, identified hereinafter as Product B, possessed the properties listed hereinbelow in Table VI.

TABLE VI

PROPERTIES OF PRODUCT B

| | |
|---|---|
| Total Base No. (TBN) | 409 |
| Equivalent Wt. | 689 |
| % Sulfonate (calculated) | 24.0 |
| % Sodium (calculated) | 17.6 |
| % Sulfur (calculated) | 1.11 |
| Viscosity at 100° C. (212° F.), cs | 64.0 |
| Density | 1.21 |
| % Sediment (ASTM D-91) | 0.03 |

The properties presented hereinabove in Table VI indicate that Product B was a composition comprising a highly basic or overbased sodium sulfonate.

EXAMPLE 3

Product B was tested in Test No. 3 in an electric motored engine which measures frictional characteristics of lubricants and predicts reduction in boundary friction and fuel savings. This electric motored engine had performance characteristics identified hereinbelow in Table VII.

TABLE VII

PERFORMANCE CHARACTERISTICS OF ELECTRIC MOTORED OLDSMOBILE ENGINE EMPLOYED IN TEST NO. 3

| | |
|---|---|
| Engine | 1967 Oldsmobile 5.7L |
| Motor | GE 15 HP |
| Engine Modifications | Intake exhaust ports blocked at head |
| Valve Spring Pressure | 97.5 kg at 1.3 cm |
| Pistons and Rings | 1-in holes, chrome rings |
| Water Jacket | Empty (dry) |
| Drive System | V Belt |
| RPM | 1650 |

TABLE VII-continued

| PERFORMANCE CHARACTERISTICS OF ELECTRIC MOTORED OLDSMOBILE ENGINE EMPLOYED IN TEST NO. 3 | |
|---|---|
| Sump Temperature | |
| °C. | 38–148 |
| °F. | 100–316 |

A 1-in diameter hole was cut in the center of each piston of the engine and the intake and exhaust ports were blocked at the head. There were no manifolds and no carburetor. The absence of manifolds and carburetor eliminated pumping factors for air. The jacket was empty and an external oil cooler was used. As the test proceeded, the crankcase temperatures increased due to internal friction from 37.8° C. (100° F.) to 149° C. (300° F.) at an engine speed of 1550 rpm. At low oil-sump temperatures, the data showed lubrication was nearly all hydrodynamic and oil viscosity was of primary importance. At high sump temperatures, friction horsepower is a function of both hydrodynamic and boundary lubrication.

A test sample was prepared by adding 0.3 percent of Product B to a conventional automobile formulated engine oil. This sample was then tested in the motored engine. In addition, a comparative sample of the conventional automobile formulated engine oil was tested. This test demonstrated a 59 percent reduction in boundary lubrication when compared to the base case automobile engine oil without the overbased sodium sulfonate.

Example 4

Another embodiment of the method of the present invention was conducted in Test No. 4. In this test, a suitable vessel, similar to that employed in Example 1, was charged with 53.6 g of sulfonic acid SA-117, a sulfonic acid available from Exxon Chemical Company, containing 70 percent sulfonic acid and 30 percent oil, 37.7 g of 5W oil obtained from Amoco Oil Company, and 300 ml of a Raffinate solvent obtained from Union Oil Company of California, namely, an aliphatic solvent having a boiling point range of about 116° C. (240° F.) to about 143° C. (290° F.). The raw materials were then mixed well and ammonia gas was used to neutralize the sulfonic acid. Then 286 g of a 20 percent sodium hydroxide in methanol solution were added to the mixture and heat was applied to raise the temperature to 116° C. (240° F.) for carbonation. During this heating and distillation period, additional Raffinate solvent was added as shown hereinbelow in Table VIII.

TABLE VIII

| DISTILLATION AND SOLVENT ADDITION DATA FROM TEST NO. 4 | | | |
|---|---|---|---|
| Temperature | | | Total Overhead, |
| °C. | °F. | Comment | ml |
| 80 | 175 | Distillation begun | — |
| 85 | 185 | Added 130 ml of Raffinate | 100 |
| 88 | 190 | Added 50 ml of Raffinate | 180 |
| 93 | 200 | Added 150 ml of Raffinate | 330 |
| 97 | 206 | — | 365 |
| 104 | 219 | — | 380 |
| 116 | 240 | — | 500 |

The resulting mixture was then carbonated at the temperature of 116° C. (240° F.) by the use of carbon dioxide and the carbon dioxide was employed at a rate of 0.25 g of carbon dioxide per minute. During the carbonation, water was formed and also some methanol was freed. In order to provide a clear product, both the water and the methanol were removed overhead and were condensed and removed from the reaction vessel. A profile taken during the carbonation is presented hereinbelow in Table IX.

TABLE IX

| CARBONATION PROFILE AND OVERHEAD IN TEST NO. 4 | | | |
|---|---|---|---|
| Time, | Temperature, | | Total Overhead, |
| min. | °C. | °F. | ml |
| 0 | 116 | 240 | — |
| 20 | 116 | 240 | 7 |
| 42 | 116 | 240 | 21 |
| 61 | 116 | 240 | 27 |
| 82 | 116 | 240 | 40 |
| 128 | 115 | 239 | 85 |
| 150 | 116 | 240 | 90 |

When carbonation had been completed, the resulting product was heated to a temperature of about 127° C. (260° F.) to remove any residual water of reaction. The product was diluted to a composition containing about 70 percent xylene to clarify the material and the diluted composition was then allowed to stand at least overnight and was subsequently decanted and filtered. Removal of the solvent was accomplished by way of conventional distillation to a temperature of 182° C. (360° F.) with nitrogen stripping. The finished product, identified hereinafter a Product C, was a bright, clear dark oil which had the properties listed hereinbelow in Table X.

TABLE X

| PROPERTIES OF PRODUCT C | |
|---|---|
| Total Base No. (TBN) | 395 |
| % Sodium Sulfonate | 25.0 |
| % Sodium | 17.2 |
| Viscosity at 100° C. (212° F.), cs | 59.6 |

The above data demonstrate that an excellent sodium sulfonate overbased material was produced.

Example 5

In this example, an embodiment of the method of the present invention was employed to produce a potassium carbonate overbased potassium sulfonate. This test is identified hereinafter as Test No. 5.

As provided in the previous examples, a suitable vessel equipped with a mechanical stirrer, condenser, and gas sparger was charged with 84.9 g of a commercially-produced ammonium sulfonate composition obtained from the Amoco Petroleum Products Company, 40.9 g of a 5W oil obtained from Amoco Oil Company, and 250 ml of reagent grade xylene obtained from Baker Chemical Company. The material in the vessel was then thoroughly mixed while a second mixture was prepared. For the second mixture, 33 g of potassium hydroxide was placed in 150 ml of methanol. The mixture of potassium hydroxide and methanol was heated to reflux and refluxed for 30 minutes. Then the first mixture containing the ammonium sulfonate oil and xylene was added to the potassium hydroxide-in-methanol composition. The resulting mixture was then heated and distillation was obtained according to the information presented hereinbelow in Table XI.

TABLE XI

| DISTILLATION AND XYLENE ADDITION DATA FROM TEST NO. 5 | | | | |
|---|---|---|---|---|
| Time, | Temperature, | | Total Overhead, | Xylene Added, |
| min. | °C. | °F. | ml | ml |
| 0 | 77 | 170 | — | — |
| 5 | 78 | 172 | 15 | — |
| 10 | 83 | 182 | 65 | — |
| 15 | 94 | 202 | 110 | — |
| 18 | 102 | 216 | 130 | — |
| 21 | 108 | 226 | 150 | 100 |
| 27 | 113 | 235 | 160 | 50 |
| 30 | 114 | 236 | 160 | — |
| 34 | 115 | 239 | 165 | — |

Carbonation of the resulting composition was begun at a temperature of about 114° C. (236° F.) without cooling, said carbonation being accomplished by passing carbon dioxide through the mixture. The carbon dioxide was employed at a rate of 0.25 g per minute. During the carbonation, water of reaction was formed and was passed along with some methanol from the mixture as overhead. Such material was removed from the reaction vessel to improve the clarity of the resulting composition. The carbonation profile that was obtained during this carbonation treatment is presented hereinbelow in Table XII.

TABLE XII

| CARBONATION PROFILE AND OVERHEAD PRODUCED IN TEST NO. 5 | | | |
|---|---|---|---|
| Time, | Temperature, | | Total Overhead, |
| min. | °C. | °F. | ml |
| 0 | 114 | 236 | — |
| 9 | 116 | 240 | 23 |
| 13 | 117 | 241 | 44 |
| 21 | 117 | 241 | 66 |
| 39 | 116 | 240 | 83 |
| 64 | 116 | 240 | 94 |
| 90 | 116 | 240 | 104 |
| 120 | 116 | 240 | 194 |

When the carbonation had been completed, the mixture was heated to a temperature of about 127° C. (260° F.) to remove any residual water of reaction. In order to clarify the resulting material, the product was diluted with xylene to about 70 percent xylene and the diluted material was permitted to stand at least overnight, after which it was decanted and filtered. Solvent was removed by means of conventional distillation to a temperature of 182° C. (360° F.) with nitrogen stripping.

The resulting clarified product, identified hereinafter as Product D, weighed 130.9 g, and provided the properties identified hereinbelow.

TABLE XIII

| PROPERTIES OF PRODUCT D | |
|---|---|
| Total Base No. (TBN) | 158 |
| % Potassium Sulfonate | 29.2 |
| % Potassium | 12.5 |
| Viscosity at 100° C. (212° F.), cs | 22.3 |

The finished product, comprising potassium overbased potassium sulfonate, had suitable viscosity and TBN values.

Each of the four products obtained hereinbefore in the examples was an excellent overbased alkali metal sulfonate. Each was shown to have relatively high TBNs and low viscosities. As shown in Example 3, Product B, an embodiment of an alkali metal overbased alkali metal sulfonate produced by the process of the present invention, provides suitable reduction in boundary friction and, consequently, in fuel savings. As demonstrated hereinabove, a very good detergent for lubricants for internal combustion engines can be produced by the process of the present invention.

What is claimed is:

1. A method for preparing a carbonate overbased alkali metal sulfonate which utilizes a single-stage carbonation, which method comprises: (1) forming a reaction mixture consisting essentially of an alkali metal compound, a lower molecular weight alkanol having from 1 to 4 carbon atoms, a diluent, a solvent, and a sulfonate compound; (2) heating said reaction mixture to a temperature of at least 104° C. (220° F.) for a period of time that is sufficient to remove essentially all of said alkanol as overhead and to obtain a heated mixture and replacing solvent that is removed along with said alkanol; (3) subjecting said heated mixture to a single carbonation at a temperature of at least 104? C. (220? F.) to form a carbonated product comprising said overbased alkali metal sulfonate while removing water of reaction as overhead as it is formed; (4) after carbonation, heating said carbonated product to a temperature that is within the range of about 116° C. (240° F. )to about 117° C. (350? F.) to remove any residual water of reaction therefrom; and (5) subsequently treating said carbonated product to remove solids and residual solvent therefrom.

2. The method of claim 1, wherein said reaction mixture is formed by mixing said sulfonate compound, said diluent, and said solvent to form a first mixture, preparing a solution of said alkali metal compound dissolved in said alkanol, and adding said solution to said first mixture to obtain said reaction mixture.

3. The method of claim 1, wherein said sulfonate compound is a member of the group consisting of sulfonic acid, ammonium sulfonate, metal sulfonates, and mixtures thereof, said diluent is a member of the group consisting of natural and synthetic oils, said solvent is a member of the group consisting of aliphatic and aromatic organic liquids having boiling points within the range of about 93° C. (200° F.) to about 204° C. (400° F.), said alkanol is a member of the group consisting of methanol, ethanol, 1-propanol, isopropanol, isobutanol, and mixtures thereof, said alkali metal compound is a member of the group consisting of the hydroxides, alkoxides, hydrides, and amides of one or more members of the group consisting of sodium, potassium, and lithium, and the temperature employed during said carbonating is within the range of about 104° C. (220° F.) to about 127° C. (260° F.).

4. The method of claim 1, wherein the initial composition of said reaction mixture comprises about 6 wt % to about 20 wt % diluent, about 30 wt % to about 60 wt % solvent, about 4 wt % to about 8 wt % sulfonate compound, and about 20 wt % to about 45 wt % sum of alkanol and alkali metal compound, each amount being based on the total weight of the reaction mixture, and the sum of alkanol and alkali metal compound containing about 5 wt % to about 20 wt % alkali metal compound, based on the weight of said sum.

5. The carbonate overbased alkali metal sulfonate prepared by the method of claim 1.

6. The method of claim 2, wherein said sulfonate compound is a member of the group consisting of sulfonic acid, ammonium sulfonate, metal sulfonates, and mixtures thereof, said diluent is a member of the group consisting of natural and synthetic oils, said solvent is a member of the group consisting of aliphatic and aromatic organic liquids having boiling points within the range of about 93° C. (200° F.) to about 204° C. (400° F.), said alkanol is a member of the group consisting of methanol, ethanol, 1-propanol, isopropanol, isobutanol, and mixtures thereof, said alkali metal compound is a member of the group consisting of the hydroxides, alkoxides, hydrides, and amides of one or more members of the group consisting of sodium, potassium, and lithium, and the temperature employed during said carbonating is within the range of about 104° C. (220° F.) to about 127° C. (260° F.).

7. The method of claim 2, wherein the initial composition of said reaction mixture comprises about 6 wt % to about 20 wt % diluent, about 30 wt % to about 60 wt % solvent, about 4 wt % to about 8 wt % sulfonate compound, and about 20 wt % to about 45 wt % sum of alkanol and alkali metal compound, each amount being based on the total weight of the reaction mixture, and the sum of alkanol and alkali metal compound containing about 5 wt % to about 20 wt % alkali metal compound, based on the weight of said sum.

8. The carbonate overbased alkali metal sulfonate prepared by the method of claim 2.

9. The method of claim 3, wherein said diluent is a natural oil having lubricating viscosity, said solvent is xylene, said alkali metal compound is sodium hydroxide, and said alkanol is methanol.

10. A lubricating oil composition comprising a major proportion of an oil of lubricating viscosity and a minor amount of the carbonate overbased alkali metal sulfonate of claim 5.

11. The method of claim 6, wherein said diluent is a natural oil having lubricating viscosity, said solvent is xylene, said alkali metal compound is sodium hydroxide, and said alkanol is methanol.

12. The method of claim 7, wherein said sulfonate compound is a member of the group consisting of sulfonic acid, ammonium sulfonate, metal sulfonates, and mixtures thereof, said diluent is a member of the group consisting of natural and synthetic oils, said solvent is a member of the group consisting of aliphatic and aromatic organic liquids having boiling points within the range of about 93° C. (200° F.) to about 204° C. (400° F.), said alkanol is a member of the group consisting of methanol, ethanol, 1-propanol, isopropanol, isobutanol, and mixtures thereof, said alkali metal compound is a member of the group consisting of the hydroxides, alkoxides, hydrides, and amides of one or more members of the group consisting of sodium, potassium, and lithium, and the temperature employed during said carbonating is within the range of about 104° C. (220° F.) to about 127° C. (260° F.).

13. A lubricating oil composition comprising a major proportion of an oil of lubricating viscosity and a minor amount of the carbonate overbased alkali metal sulfonate of claim 8.

14. The carbonate overbased alkali metal sulfonate prepared by the method of claim 9.

15. The carbonate overbased alkali metal sulfonate prepared by the method of claim 11.

16. The method of claim 12, wherein said diluent is a natural oil having lubricating viscosity, said solvent is xylene, said alkali metal compound is sodium hydroxide, and said alkanol is methanol.

17. A lubricating oil composition comprising a major proportion of an oil of lubricating viscosity and a minor amount of the alkali metal carbonate alkali metal sulfonate of claim 14.

18. A lubricating oil composition comprising a major proportion of an oil of lubricating viscosity and a minor amount of the alkali metal carbonate alkali metal sulfonate of claim 15.

19. The carbonate overbased alkali metal sulfonate prepared by the method of claim 16.

20. A lubricating oil composition comprising a major proportion of an oil of lubricating viscosity and a minor amount of the carbonate overbased alkali metal sulfonate of claim 19.

21. A method for preparing a carbonate overbased sodium sulfonate, which method comprises: (1) mixing an ammonium sulfonate or metal sulfonate, an oil having a viscosity within the range of about 35 SUS to about 500 SUS at 37.8° C. (100° F.) as a diluent, and xylene as a solvent to form a first mixture; (2) preparing a solution of about 5 wt % to about 20 wt % sodium hydroxide dissolved in methanol; (3) adding said solution to said first mixture to obtain a second mixture; (4) heating said second mixture to a temperature within the range of about 104° C. (220° F.) to about 127° C. (260° F.) for a period of time that is sufficient to remove essentially all of said methanol as overhead, replacing said xylene which is removed in the overhead; (5) passing carbon dioxide through said mixture at a temperature within the range of about 104° C. (220° F.) to about 127° C. (260° F.) until carbonation is completed; (6) stopping the flow of carbon dioxide an heating the carbonated product to a temperature within the range of about 116° C. (240° F.) to about 177° C. (350° F.) to remove residual water of reaction; and (7) treating said carbonated product to remove solids and solvent.

* * * * *

UNITED STATES PATENT OFFICE

CERTIFICATE OF CORRECTION

Patent No. 4,867,891 Dated September 19, 1989

Inventor(s) Mack W. Hunt

It is certified that error appears in the above-identified patent and that said Letters Patent is hereby corrected as shown below:

Title page:

| Abstract | Lines | |
|---|---|---|
| | 7 & 12 | "140°C." and should read --104°C.-- |

Signed and Sealed this

Twelfth Day of June, 1990

*Attest:*

HARRY F. MANBECK, JR.

*Attesting Officer*

*Commissioner of Patents and Trademarks*